US005095874A

United States Patent [19]

Schnaibel et al.

[11] Patent Number: 5,095,874

[45] Date of Patent: Mar. 17, 1992

[54] METHOD FOR ADJUSTED AIR AND FUEL QUANTITIES FOR A MULTI-CYLINDER INTERNAL COMBUSTION ENGINE

[75] Inventors: Eberhard Schnaibel, Hemmingen; Erich Schneider, Kirchheim; Martin Klenk, Backnang; Winfried Moser, Ludwigsburg; Christian Klinke, Pleidelsheim; Lutz Reuschenbach, Stuttgart; Klaus Benninger, Vaihingen/Enz, all of Fed. Rep. of Germany

[73] Assignee: Robert Bosch GmbH, Stuttgart, Fed. Rep. of Germany

[21] Appl. No.: 679,044

[22] PCT Filed: Jul. 24, 1990

[86] PCT No.: PCT/DE90/00560

§ 371 Date: May 13, 1991

§ 102(e) Date: May 13, 1991

[87] PCT Pub. No.: WO91/04401

PCT Pub. Date: Apr. 4, 1991

[30] Foreign Application Priority Data

Sep. 12, 1989 [DE] Fed. Rep. of Germany .... 3930396.9

[51] Int. Cl.[5] ..... F02D 41/30

[52] U.S. Cl. ..... 123/361; 123/399; 123/478; 123/492

[58] Field of Search ..... 123/339, 361, 399, 478, 123/480, 492, 493, 494

[56] References Cited

U.S. PATENT DOCUMENTS

| | | | |
|---|---|---|---|
| 4,031,780 | 11/1981 | Hoshi | 123/486 |
| 4,237,830 | 12/1980 | Stivender | 123/399 X |
| 4,359,993 | 11/1982 | Carlson | 123/492 |
| 4,667,640 | 5/1987 | Sekozawa et al. | 123/492 |
| 4,711,218 | 12/1987 | Kabasin | 123/492 |
| 4,763,264 | 8/1988 | Okuno et al. | 123/399 X |
| 4,771,752 | 9/1988 | Nishimura et al. | 123/399 X |
| 4,805,577 | 2/1989 | Kanno et al. | 123/492 X |
| 4,838,223 | 6/1989 | Tanabe et al. | 123/339 |
| 4,883,035 | 11/1989 | Shimomura et al. | 123/361 |
| 4,953,530 | 9/1990 | Manaka et al. | 123/399 |
| 4,987,888 | 1/1991 | Funabashi et al. | 123/492 X |
| 5,025,380 | 6/1991 | Wataya et al. | 123/478 X |

FOREIGN PATENT DOCUMENTS

| | | | |
|---|---|---|---|
| 0142856 | 5/1985 | European Pat. Off. . | |
| 2534708 | 4/1984 | France . | |
| 02066625 | 11/1984 | Japan | 123/399 |
| 0040745 | 3/1985 | Japan | 123/399 |
| 2218828 | 11/1989 | United Kingdom . | |

OTHER PUBLICATIONS

"Regelverfahren in der elektronischen Motorsteuerung-Teil 2" by U. Kiencke and C.-T. Cao in "Automobil-Industrie", No. 2, (2-1988), pp. 135-144.

*Primary Examiner*—Willis R. Wolfe
*Attorney, Agent, or Firm*—Walter Ottesen

[57] ABSTRACT

In a method for adjusting air and fuel masses for a multi-cylinder internal combustion engine with individual injection for each cylinder, the fuel mass for each injection operation is calculated taking into account the probable intake-pipe pressure during the opening time of the inlet valve. After a change of the accelerator pedal, the throttle flap is only adjusted when the fuel masses decisive for the new throttle-flap position have been calculated and substantially ejected. By virtue of the fact that fuel masses to be injected are not calculated taking into account the current air mass flow but taking into account the intake-pipe pressure, which is decisive in the induction operation, and that a change in the actuation of the throttle flap, which would lead to a change in the intake-pipe pressure not taken into account in the calculation of the injection quantity, is only permitted again after a recalculation, an optimum ratio between fuel mass and air mass per charge for the purpose of obtaining a specified value for the air/fuel ratio is always obtained, even in non-steady-state conditions of an internal combustion engine. Apart from the future intake-pipe pressure, account is also taken in the calculation of the fuel mass to be ejected of how much fuel passes into a wall film or is released from the latter.

7 Claims, 2 Drawing Sheets

METHOD FOR ADJUSTED AIR AND FUEL QUANTITIES FOR A MULTI-CYLINDER INTERNAL COMBUSTION ENGINE

FIELD OF THE INVENTION

The invention relates to a method for adjusting air and fuel quantities for a multi-cylinder internal combustion engine with individual injection for each cylinder and with an electronically driven actuator for the air-flow controlling element. In the relevant technical field, the air-flow controlling element is generally designed as a throttle flap, for which reason reference is made below constantly to a throttle flap for the sake of clarity, instead of an air-flow controlling element in general. However, attention is drawn to the fact that the air-flow controlling element can be of any desired design.

BACKGROUND OF THE INVENTION

For individual injection for each cylinder of a multi-cylinder internal combustion engine, there are essentially two methods known, namely that of central injection and that of sequential injection into one intake-pipe portion for each cylinder. In the case of central injection, the distance between the common intake pipe and the individual cylinders is relatively long. In a four-stroke, four-cylinder engine with the induction-stroke sequence 1, 3, 4, 2, the fuel quantity to be drawn in by the first cylinder is already injected during the induction stroke for the fourth cylinder. The entire induction stroke for the second cylinder then follows, until finally the first cylinder draws in the fuel quantity injected for it into the intake pipe. By means of the beginning and length of the injection pulses it is possible to apportion the fuel quantities to the individual cylinders to some extent individually. Such a method is described in U.S. Pat. No. 4,301,780.

Very precise individual metering of fuel quantities to individual cylinders is possible with sequential injection. Here, an injection valve is allocated to each cylinder and this valve is activated separately.

In addition to the fuel quantities, the air quantities must also be adjusted. In the most widely used methods, the air quantity is adjusted by the throttle flap being adjusted directly by actuating the accelerator pedal. In more modern methods involving a so-called electronic accelerator pedal, such direct coupling is absent; rather, the accelerator-pedal signal is converted into an actuating signal for an actuator for the throttle flap. In such methods, the throttle flap is likewise adjusted directly upon actuation of the accelerator pedal but the extent of the adjustment of the throttle flap depends not only on the angle of the accelerator pedal but also on the current values of specified operating parameters. In a further-reaching proposal in U.S. Pat. No. 4,883,035, an offset between the actuation of the accelerator pedal and the adjustment of the throttle flap is additionally provided. This method is based on the realization that the adjustment of the throttle flap during an induction stroke leads to unfavorable driving performance in the case of an internal combustion engine with central injection. An adjustment of the accelerator pedal thus does not lead directly to an adjustment of the throttle flap; rather, after a change in the accelerator-pedal position is detected, the beginning of the immediately following induction stroke is awaited, whereupon the position of the throttle flap is adjusted to the value specified by the accelerator-pedal position, taking into account the current operating parameters.

Another method in which the adjustment of an air-flow controlling element is delayed relative to the time at which a demand for more fuel occurs is known from U.S. Pat. No. 4,838,223. This is a method for metering additional fuel masses for the purpose of operating additional units, such as an air-conditioning system. When the air-conditioning system is switched on, more air and more fuel must be supplied in order to avoid a break in the speed when idling. A fuel quantity increased by a fixed predetermined value in relation to the case without additional loading is first of all injected and only then is the idle bypass valve opened somewhat further. Only when the torque which can be output has been increased by these measures is the clutch for the air-conditioning system brought into engagement.

All methods known to date for adjusting air and fuel masses for a multi-cylinder internal combustion engine lead to driving performances in non-steady-state transitions which are not completely satisfactory. There is therefore the general problem of improving methods of this kind in such a way that driving performance and toxic gas characteristics are better.

SUMMARY OF THE INVENTION

Decisive for the method according to the invention is that the air mass taken as a basis in the calculation of each fuel-mass value is the air mass which will, taking into account the then existing position of the air-mass controlling element, probably be drawn in during the induction stroke for which the fuel mass is being calculated. It is furthermore advantageous to activate the actuator for the air-controlling element with a position-changing voltage essentially at that time which is earlier by the controlling element dead time than the time of that throttle-flap movement for which a fuel mass has already been calculated taking into account this throttle-flap movement. This teaching is illustrated further below by means of illustrative embodiments.

The teaching according to the invention is based on the realization that all known methods without exception suffer from the fact that it is assumed that fuel masses to be drawn in in the future are calculated using the current values of operating parameters, in particular using the current intake-pipe pressure, instead of on the basis of those values which will probably exist at the time at which the previously-injected fuel is drawn in.

The invention is based on the realization that, following an essentially abrupt position change of the throttle flap, the intake-pipe pressure does not change abruptly but in accordance with a transient function, essentially a transient function of the first order, the time constant of which is generally dependent on the operating point. If this fact is taken into account in the calculation of the fuel mass drawn in in the future, considerably improved driving performance and toxic gas characteristics are obtained. A comparison may be drawn at this point with the publication known from the already mentioned U.S. Pat. No. 4,883,035. In this known method, the fuel mass is determined taking into account the current intake-pipe pressure and the throttle flap is changed at the beginning of the induction stroke following a change in the pedal position. This procedure leads immediately to two problems. The first consists in the fact that the fuel mass which is drawn in during an induction stroke following a change in the pedal position was already injected before the change in the pedal position It is therefore a fuel mass which does not match the throttle-flap position newly established at the beginning of the new induction stroke. The second problem is that although a fuel mass which has been calculated directly after a change in the pedal position does already take into account the new pedal position, it does not yet take into account the intake-pipe pressure as it exists when this fuel mass is finally injected.

None of these problems exist in the method according to the invention since, in this method, any fuel mass to be drawn in in the future is calculated taking into account the air mass which will probably be drawn in then and an adjustment of the throttle flap is not permitted while the fuel ejected but not drawn in is still that which has not been calculated taking into account the new throttle-flap position. This prediction can be performed very precisely since the deviation of the change of the intake-pipe pressure from a transient function of the first order is not large and other effects do not play a significant role or can likewise be easily compensated, such as, in particular, effects of the wall film behavior.

In the method according to the invention, the accelerator-pedal position can be converted into a throttle-flap position in a conventional manner and the fuel mass can be changed in adaptation to operating parameters in such a way that an essentially constant lambda value is obtained. Preferably, however, the procedure adopted is that the desired fuel mass is specified directly by the accelerator-pedal position The throttle-flap position is then adjusted, taking into account corresponding current values of operating parameters, in such a way that a specified lambda value is essentially maintained. In this case, there corresponds to each position of the accelerator pedal a particular torque, whereas, in the above-mentioned method, the torque changes with the speed. In the preferred method, in which the torque is determined by the accelerator-pedal position, it is possible in a simple manner to take into account additional requirements in relation to torque processes. As already explained above, the switching in of an air-conditioning system during idle, for example, requires that the torque be increased. On the other hand, a drive slip control may, for example, require a reduction of the torque. These various torque demands can easily be combined logically with the driving demand specified via the accelerator pedal since the accelerator-pedal position also corresponds to a torque demand.

DESCRIPTION OF THE PREFERRED EMBODIMENTS OF THE INVENTION

Figures 1, 2:
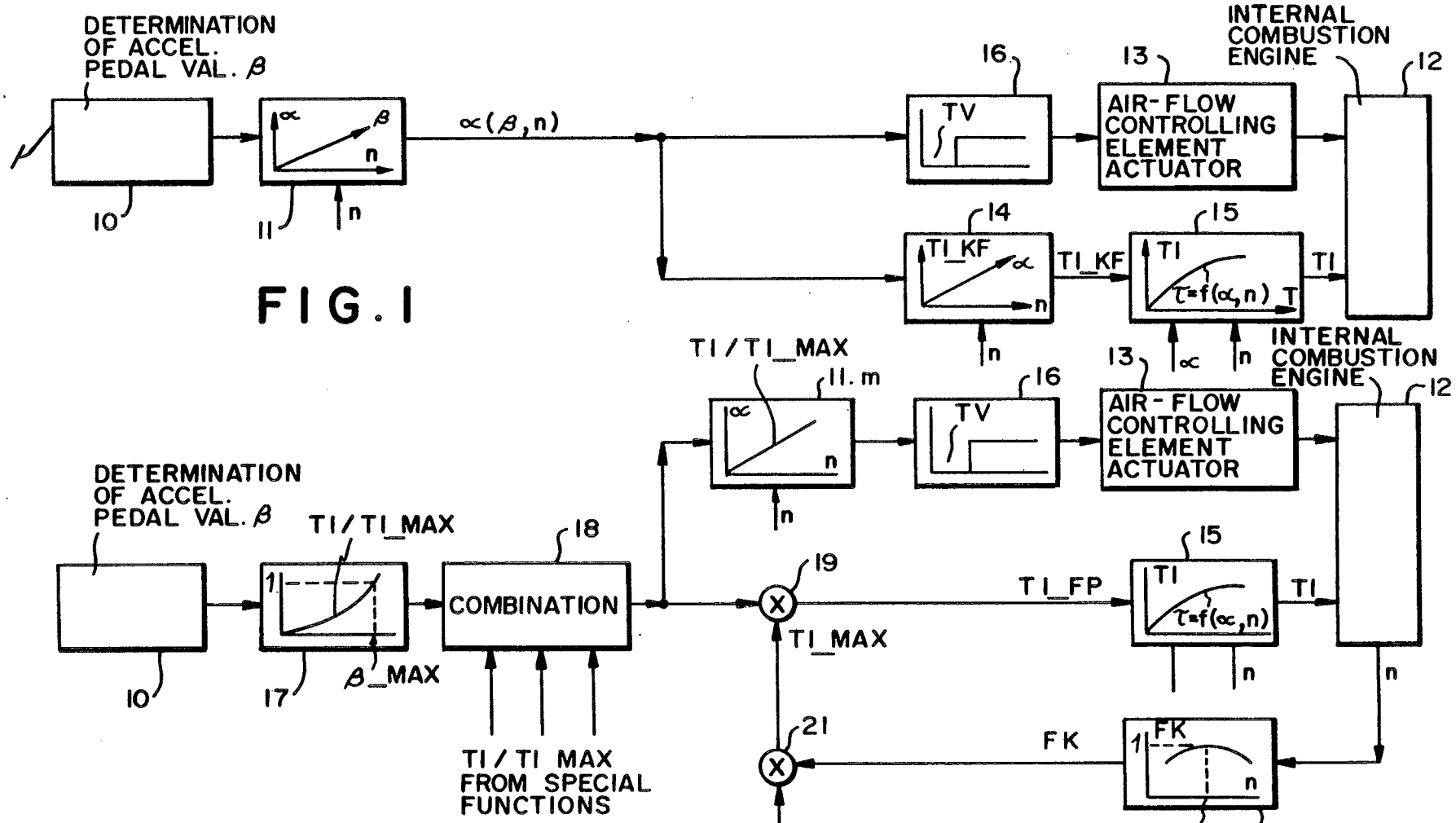
FIG. 1 block diagram of a method for calculating fuel masses to be drawn in in the future with the desired throttle-flap angle being specified.
FIG. 2 block circuit diagram corresponding to that in FIG. 1 but with specification of the desired fuel mass.

In the course of the method according to FIG. 1, a voltage is formed by an accelerator-pedal potentiometer 10 and this voltage is a measure of the accelerator-pedal angle $\beta$. The accelerator-pedal angle signal is used to drive a throttle-flap angle characteristic field 11. Throttle-flap angles $\alpha$ ($\beta$, n) addressable via values of the accelerator-pedal angle and, in addition, the speed n of an internal combustion engine 12 can be read out from this characteristic field. The signal for the throttle-flap angle on the one hand determines the voltage with which a throttle-flap actuator 13 is to be activated in order to achieve the desired throttle-flap angle $\alpha$ but, on the other hand, also determines the injection time TI.

In order to determine the injection time TI, starting from the throttle-flap angle $\alpha$, a characteristic-field value TI_KF is first of all read out of a characteristic field addressable via values of the throttle-flap angle and the speed n. After this reading out of the characteristic-field value TI_KF there follows that step of the method which brings the decisive improvement over customary methods known to date. The injection-time value read out from the injection-time characteristic field 14 in relation to a throttle-flap angle $\alpha$ and the current speed n is not used directly but is subjected in a filtering step 15 to a transient function of the first order which has a time constant $\tau$ which depends on the throttle-flap position and the speed. At each time at which a change in the throttle-flap angle or the speed is input, the injection-time value TI achieved up to that point is determined and subjected to the transient function with the current time constant $\tau$ ($\alpha$, n), which, in certain circumstances, may also depend on the sign of the throttle-flap change. The injection time TI output by this filtering step 15 is that which is actually used to activate an injection valve.

The procedure of subjecting the characteristic-field injection time TI_KF read out of the injection-time characteristic field 14 to a transient function of the first order is based on the following observation. If the throttle flap is set at a particular time to a throttle-flap angle $\alpha$ output by the throttle-flap angle characteristic field 11 which is larger than the previously existing throttle-flap angle, this does not lead to an abrupt rise in the intake pressure but to an increase in the intake pressure with a time response which corresponds very precisely to that of a transient function of the first order. From the injection-time characteristic field 14, a characteristic-field injection time TI_KF is read out which is valid for a steady-state condition with the throttle-flap angle $\alpha$ and the speed n. Because of the transient response of the first order, it is necessary that only a little more fuel be injected for the induction stroke immediately following the throttle-flap angle increase than would be the case without the throttle-flap angle increase. This is because the intake-pipe pressure has as yet hardly risen in the case of this induction stroke immediately following the throttle-flap angle increase. However, the intake-pipe pressure increases from induction stroke to induction stroke in accordance with the transient function of the first order, for which reason too the fuel quantity can be increased for each successive induction stroke.

It is pointed out that, after a change in the position of the throttle flap, the percentage speed change during an induction stroke is only very small. In practice, therefore, it does not lead to any considerable error if the calculation of an air mass drawn in in an induction stroke, and hence the associated injection time TI, is based on a speed which is constant during the induction stroke.

As can be seen from the above, the fuel quantity to be injected depends on the intake-pipe pressure at the time of that induction stroke for which the fuel quantity is calculated. The intake-pipe pressure itself depends on the throttle-flap angle, the speed and, decisively, on the time at which the change in the throttle-flap position occurs. This means, however, that the throttle flap must not be adjusted before fuel quantities for the new throttle-flap position have been calculated. This may be illustrated by means of an example.

Let it be assumed that the engine is of the four-cylinder, four-stroke type and let cylinder 1 of this engine be considered. In each fourth induction stroke, cylinder 1 performs induction. However, let it be assumed here that the injection of fuel into the intake-pipe portion associated with this cylinder is already begun three induction strokes before the induction stroke of this cylinder. Let it be assumed that the accelerator-pedal angle $\beta$ is increased precisely three induction strokes before the induction stroke for cylinder 1. At this instant, the ejection of fuel for cylinder 1 has already been begun. The fuel mass to be injected had been calculated taking into account the old accelerator-pedal angle, more precisely taking into account the throttle-flap angle associated with the old pedal angle and hence the air mass per stroke associated with this angle. In addition, at this time the fuel injection operations for other cylinders which have not yet performed induction are under way or already completed. If, with the increasing of the accelerator-pedal angle $\beta$, the throttle-flap angle $\alpha$ were raised immediately to the value read out from the throttle-flap angle characteristic field 11, the mixture formed in all the cylinders for which fuel had already been injected on the basis of the old air-flow conditions would be very lean. The adjustment of the throttle flap is thus postponed until the fuel quantity available for induction is one which has already been calculated taking into account the new throttle-flap angle. In the example, it has been assumed that fuel for cylinder 1 is being injected precisely at the time at which the pedal angle is changed. After cylinder 1, it is assumed that cylinder 3 performs induction. The fuel quantity for cylinder 3 can already be calculated taking into consideration the new throttle-flap position, which has, however, not yet been set. This fuel quantity is moreover immediately injected. Once three induction strokes have passed since the changing of the accelerator-pedal position, the throttle-flap position is then adapted to the new accelerator-pedal position and cylinder 3 now draws fuel in as the first cylinder at the new throttle-flap position, in a quantity which has been calculated for this position for the first time. In calculating the fuel quantity, account is taken of the fact that the throttle flap is only opened to its new value at the beginning of the induction stroke now under consideration, that is that the intake-pipe pressure does not yet have the final value for steady-state condition at the new throttle-flap position.

The offset discussed above between the time at which the accelerator pedal is adjusted and the time at which the throttle flap is adjusted is calculated in an offset step 16. The offset time TV is dependent, in particular, on how long before a particular induction stroke fuel is already injected for this induction stroke. In the example given above, it is the time of three induction strokes. Only at the beginning of the sixth stroke is it permissible for the throttle flap to be adapted to the changed accelerator-pedal position. If the throttle-flap actuator 13 did not have any dead time, it would ideally be activated at an angle mark at which an inlet valve opens. However, since the throttle-flap actuator 13 has a dead time of a few milliseconds, it must be activated by the corresponding amount of time before an angle mark of this type in order to ensure that the beginning of a new throttle-flap movement does in fact coincide with the beginning of an induction stroke.

It is assumed above that each beginning of one induction stroke follows precisely the end of the preceding induction stroke. If induction strokes overlap, then, in the respective zone between the beginning and the end of two adjacent induction strokes, the throttle flap is preferably opened nearer to the beginning of the following stroke, in certain circumstances exactly at the beginning of the following stroke. The actuator is activated in advance by the amount of the dead time. As already explained, however, an adjustment of the throttle flap should not take place before the time at which the first fuel mass calculated following a change of the accelerator-pedal position is drawn in.

The offset period, mentioned in the example above, of three induction strokes is a relatively long period among the periods which are used in practice. It guarantees that all the fuel can still be ejected within one cycle period even at maximum speed and maximum load. In the limit case, the offset period can fall as far as the value zero, if, in the case of sequential injection, injection is only performed simultaneously with the opening of an inlet valve associated with an injection valve and/or speed and load are low. Here, an offset occurs only in special cases, namely when the accelerator pedal is displaced very shortly before the beginning of an induction stroke, more precisely by a period which is shorter than the dead time of the actuator. Although, under certain circumstances, the fuel quantity could then be calculated already for a new throttle-flap position, this could no longer be set because of the dead time. The throttle flap is then left in its old position for the time being and the fuel mass calculated for the old conditions is ejected. However, the actuator is then activated by the amount of the controlling element dead time before the beginning of the next induction stroke and the fuel mass for the next induction stroke is calculated taking into account the intake-pipe pressure established in the case of the new throttle-flap position.

It is pointed out that a throttle flap does not change its position abruptly when the associated throttle-flap actuator is activated with a position-changing voltage. If the error due to this behavior is to be avoided, the time constant $\tau(\alpha, n)$ in the filtering step 15 is determined taking into account the throttle-flap angle actually existing at a particular time instead of on the basis of the desired throttle-flap angle. For the purpose of calculating the actual throttle-flap angle, a first-order time delay element or a ramp with limitation, for example, can be used as a model.

The illustrative embodiment according to FIG. 2 differs from all the methods known up to date in the prior art not only by virtue of the filtering step 15, which is also used here, but also by the fact that a throttle-flap angle $\alpha$ is not calculated from the accelerator-pedal angle $\beta$ but that the desired fuel quantity is specified directly. This measure can be employed even without the filtering step 15. The specification of the fuel quantity corresponds to the specification of a torque. Each accelerator-pedal position is thus associated essentially with a particular torque. If, on the other hand, the throttle-flap angle is determined by the accelerator-pedal position, more and more fuel is injected as the speed rises, with the result that the torque increases. An example of how the desired torque can be achieved is given by FIG. 2.

In the method according to FIG. 2, the output signal from the accelerator-pedal potentiometer 10 is supplied to a characteristic-curve table 17, which establishes a non-linear relationship between the pedal angle and an injection-time ratio quantity TI/TI_MAX. The ratio quantity indicates how large a percentage of the maximum fuel quantity possible under the existing operating conditions is desired. The characteristic is non-linear, with an increasing gradient towards larger pedal angles, in order to improve the starting behavior of a vehicle.

The ratio output by the characteristic-curve table 17 is combined in a logic operation step 18 with torque specifications as input by special functions. Let it be assumed initially that the ratio output by the characteristic-curve table 17 passes unchanged through the logic operation step 18. For the purpose of setting the throttle flap in accordance with the ratio, the ratio is first of all supplied to a modified throttle-flap characteristic field ll.m, from which a throttle-flap desired angle $\alpha$ is read out as a function of values of the speed n and the ratio. The activating voltage, associated with this desired angle, for the throttle-flap actuator 13 is again not supplied to the actuator directly but via the offset step 16. The function of the step 16 is identical to the function described above, for which reason no further details are given here of the adjusting of the throttle flap.

From the injection-time ratio TI/TI_MAX, an injection time TI_FP specified by the accelerator pedal is obtained by the ratio being multiplied in a multiplication step 19 by an injection time TI_MAX which corresponds to that injection time which produces the maximum torque at the existing speed n. For the purpose of calculating TI_MAX, it is assumed that the internal combustion engine 12 has maximum charge at a very specific speed n_0 and at the same time produces its maximum torque and that, during this process, fuel is injected in compliance with the injection time TI_MAX_0. For all other speeds, the air charge is less. A charge correction factor FK is therefore read out of a torque characteristic-curve table 20, which factor has the value one at the speed n_0. In the direction of higher and also of lower speeds, the charge decreases, for which reason the charge correction factor FK falls to values less than one. This charge correction factor FK is used in a multiplicative charge correction step 21 to correct the value TI_MAX _0 to give TI_MAX=-TI_MAX_0×FK. From this maximum injection time TI_MAX, which is valid for a particular speed n, the injection time TI_FP associated with the accelerator-pedal position is, as mentioned, calculated by multiplicative combination with the ratio from the characteristic-curve table 17. This specified injection time is subjected to the filtering step 15 explained in detail above whereby the actual injection time TI is obtained.

To conclude the discussion of FIG. 2, the task of the logic operation step 18 will be explained in greater detail. Ratios TI/TI_MAX from special functions are supplied to this logic operation step 18. If, for example, the air-conditioning system is switched on during idle, this means an increased torque requirement. Accordingly, the idle charge control outputs a relatively high value for the desired ratio TI/TI_MAX. In the logic operation step 18, this ratio from the idle charge control is selected in the sense of a maximum value selection. If, on the other hand, a low ratio TI/TI_MAX is input, for example from a drive slip control, in order to prevent spinning of the driving wheels by providing a low torque, this value is allowed through by the logic operation step 18 in the sense of a minimum value selection. If several ratio specifications reach the logic operation step 18, it allows only one ratio through in the sense of a priority selection.

In the prior art, in which a throttle-flap position instead of a torque-indicating variable was derived from an accelerator position, the combination with special functions which indicate torque demands was relatively difficult. It was namely not possible to intervene in a signal-processing path influencing the torque.

Several references have been made above to the significance of the filtering step 15, that is, to the importance of the calculation of a fuel mass drawn in in the future taking into account the conditions expected in the future. In the methods according to FIGS. 1 and 2, the only future condition taken into account was the intake-pipe pressure in its capacity as a measure of the cylinder charge (air mass per stroke). The situation is however that the intake-pipe pressure not only influences the air mass which can be drawn in but also determines the behavior of the fuel wall film. If the pressure and the mass flow of fuel increase, part of the fuel injected goes into the wall film while, conversely, fuel is released from the wall film if the intake pressure falls. The injected fuel mass must be corrected accordingly in order to actually draw in with an air mass drawn in that fuel mass which is required for establishing a particular lambda value.

Figure 3:
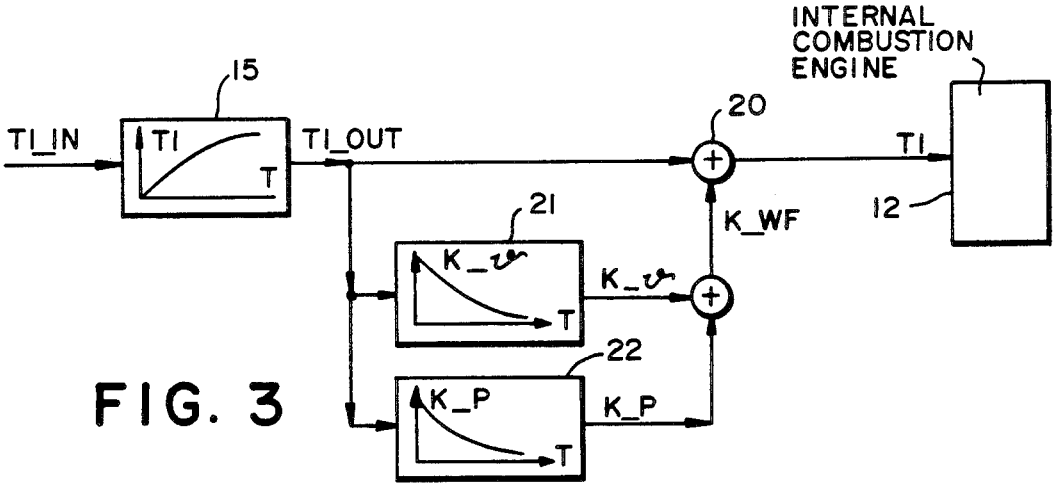
FIG. 3 block circuit diagram of a partial method, in which the wall film behavior is also taken into account in the calculation of fuel masses to be drawn in in the future.

In FIG. 3, the only part of the block diagrams according to FIGS. 1 and 2 which is shown is that between the filtering step 15 and the outputting of the injection time TI to the internal combustion engine 12. An input injection time TI_IN is fed to the filtering step 15, whether this time is the characteristic-field injection time TI_KF according to FIG. 1 or the accelerator-pedal demand injection time TI_FP according to FIG. 2. The filtering step 15 outputs an output injection time TI_OUT, which does not yet correspond directly to the injection time TI with which an injection valve in the internal combustion engine 12 is activated. Rather, the output injection time TI_OUT is combined additively in a wall-film correction step 20 with a wall-film correction variable K_WF, the actual injection time TI only then being formed. The wall-film correction variable K_WF is composed of two parts added together, namely a thermal correction variable K_$\theta$ and a pressure correction variable K_P. The particular current value for the thermal correction variable is calculated in a temperature-effect correction step 21, while the value for the pressure correction variable is calculated in a pressure-effect correction step 22. In both correction steps, the values of the correction variables are calculated on the basis of a decaying function, the time constant for the temperature effect being slower than that for the pressure effect. The decaying behavior is recalculated with each change of the input variable for the correction steps.

Figure 4:
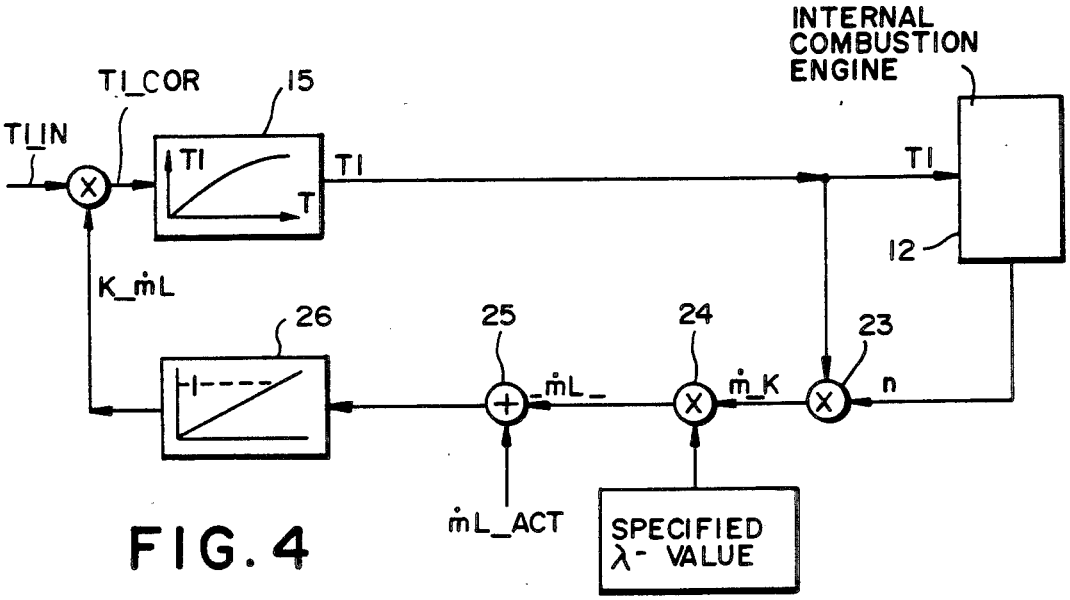
FIG. 4 block diagram of a partial method according to which air-density changes are adapted for calculating fuel masses drawn in in the future; and, FIG. 5 block diagram of a partial method according to which a lambda control is included in the calculation procedure for fuel quantities to be drawn in in the future.

As in the case of FIG. 3, FIG. 4 is a representation to illustrate a correction method which can be used both in the method according to FIG. 1 and in that according to FIG. 2. The methods according to FIGS. 3 and 4 can also be used together. The method according to FIG. 4 serves to take into account changes in the air mass drawn in relative to the value which applies under calibration conditions. The fuel flow ṁ K is calculated from the speed n and the injection time TI in a fuel-flow determination step 23. The value obtained is multiplied in a desired air-flow determination step 24 with the specified lambda value. The mass flow of air which would have to exist in order to obtain the specified lambda value at the fuel flow established by the injection is then known. The particular current value for the desired air flow ṁ L_DES, is subtracted in an air-flow comparison step 25 from the particular current value of the actual air flow ṁ L_ACT, as output by an air mass meter. The difference value is processed further in an integration step 26, in which integration is performed around the value one. The integration value is the corresponding current value for an air-mass correction variable K_ṁ L, with which the input value for the injection time TI_ONE, explained with reference to FIG. 3, is multiplicatively combined in an air-mass correction step 27. If the desired and actual airflows constantly coincide, the multiplicative air-mass correction variable has the value one. If the vehicle on which the method is performed drives to a higher altitude than that for which the various characteristic fields and characteristic curves used have been determined, then, for a particular speed dependent upon throttle-flap positions, the air mass drawn in no longer coincides with the expected air mass. A negative difference of the air masses is obtained, for which reason integration is carried out towards smaller values in the integration step 26. This leads to a reduced injection time TI in adaptation to an air mass flow which is lower than the air mass flow expected for the calibration air pressure.

Figure 5:
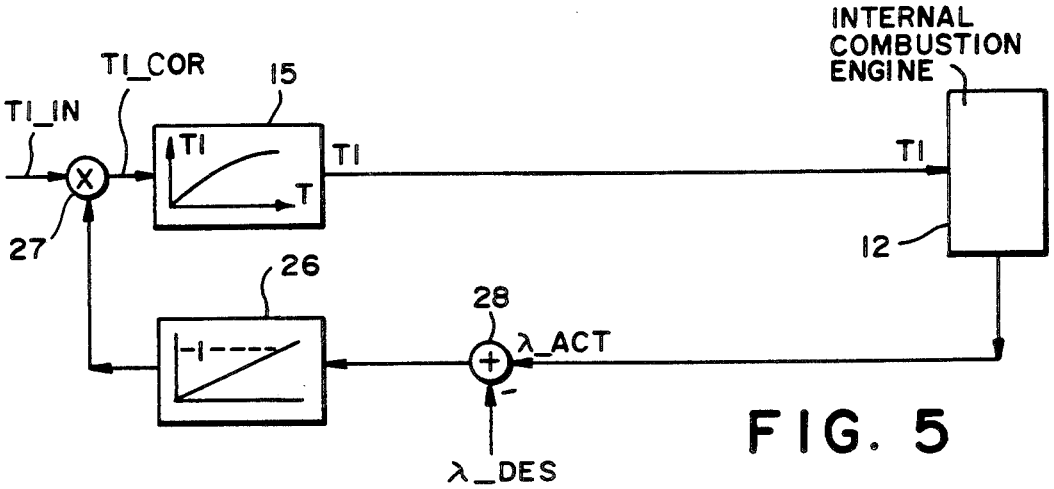

The method according to FIG. 5 is similar to that of FIG. 4, with an integration step 26 and an air-mass correction step 27. In the integration step 26, however, it is not an air-flow difference signal but a lambda-value difference signal which is processed. An actual lambda value LAMBDA_ACT is measured in the exhaust gas of the internal combustion engine 12. From this value, the desired lambda value LAMBDA_DES is subtracted in a lambda-value comparison step 28. If the difference deviates from zero, the integration step 26 is carried out in corresponding fashion to the method according to FIG. 4.

Attention is drawn to the fact that a simulation of the time characteristic of the intake-pipe pressure can be accomplished by any known model, that is not just according to the model of the filtering step 15. An intake-pipe pressure model is described, for example, by U. Kienke and C.—T. Cao in Automobil-Industrie No. 2, 1988, pages 135 and 136 under point 4.1 of an article with the title "Regelverfahren in der elektronischen Motorsteuerung". Under point 4.2 they state how this model is used for idle speed control. The corresponding current intake-pipe pressure, which is not measured, is calculated in a recursion process with the aid of the model. Calculation of the future intake-pipe pressure for metering in the current fuel mass to be ejected for a future air mass is not performed in the method described there.

We claim:

1. A method for adjusting air and fuel masses for a multi-cylinder internal combustion engine with individual injection for each cylinder and with an electronically driven actuator for an air-flow controlling element with the actuator having a predetermined dead time, the method comprising the steps of:

determining a change in position of the accelerator pedal;

driving the actuator to change the position of the air-flow controlling element in order to establish a new position thereof only at such time points which lie in advance of the start of a new movement of the air-flow controlling element by the amount of said dead time; said start being the basis of the injection time computation; and, computing the fuel mass for each future induction stroke while considering that air mass per stroke which air mass will be inducted during said future induction stroke for the position of the actuator at the time of the future induction stroke.

2. The method of claim 1, wherein each air mass calculated for a future induction stroke is calculated taking into account the wall film behavior to be expected during the future induction stroke.

3. The method of claim 1, wherein a fuel-mass signal by means of which the fuel mass desired in the future is determined, is formed by the accelerator-pedal position.

4. The method of claim 3, wherein the accelerator-pedal position determines the ratio of the actual fuel mass to be ejected to a maximum ejectable fuel mass under the particular operating conditions which are present.

5. The method of claim 4, wherein the maximum ejectable fuel mass is obtained with the aid of a characteristic curve which describes the maximum air charge as a function of the particular speed which is present.

6. The method of claim 3, wherein fuel mass signals, as output by special controls, for example an idle-charge control or a drive slip control, are combined with the fuel-mass signal obtained from the accelerator-pedal position.

7. The method of claim 6, wherein the combination is effected by a logic selection.

* * * * *

UNITED STATES PATENT AND TRADEMARK OFFICE

CERTIFICATE OF CORRECTION

PATENT NO. : 5,095,874

DATED : March 17, 1992

INVENTOR(S) : E. Schnaibel, E. Schneider, M. Klenk, W. Moser, C. Klinke, L. Reuschenbach and K. Benninger It is certified that error appears in the above-identified patent and that said Letters Patent is hereby corrected as shown below:

On the title page, in the title, reference numeral [54], line 1: delete "ADJUSTED" and substitute -- ADJUSTING -- therefor.

In the title page, under "References Cited", reference numeral [56]: delete "4,031,780" and substitute -- 4,301,780 -- therefor.

In column 1, line 1: delete "ADJUSTED" and substitute -- ADJUSTING -- therefor.

In column 2, line 68: after "position", insert -- . --.

In column 3, line 30: after "position" (first occurrence), insert -- . --.

Signed and Sealed this

Fifteenth Day of June, 1993

Attest:

Michael K. Kirk

MICHAEL K. KIRK

Attesting Officer

Acting Commissioner of Patents and Trademarks